United States Patent [19]

Shaffer et al.

[11] 4,025,145

[45] May 24, 1977

[54] REPAIRABLE SHIELDED CABLE CONNECTOR

[75] Inventors: Clifford K. Shaffer, Westfield; Joe B. Weiss, Indianapolis, both of Ind.

[73] Assignee: The United States of America as represented by the Secretary of the Navy, Washington, D.C.

[22] Filed: May 17, 1976

[21] Appl. No.: 686,769

[52] U.S. Cl. ..... 339/143 R; 29/628; 174/90; 339/89 M

[51] Int. Cl.[2] ..... H01R 19/06; H01R 43/04

[58] Field of Search ..... 339/143 R, 143 C, 14 R, 339/89 R, 89 C, 90 R, 90 C, 91 P, 177 R, 177 E; 174/89, 90; 29/628

[56] References Cited

UNITED STATES PATENTS

| | | | |
|---|---|---|---|
| 2,258,737 | 10/1941 | Browne | 339/177 R |
| 3,046,515 | 7/1962 | Appleton | 339/90 R X |
| 3,391,380 | 7/1968 | Livingston | 339/143 R |

*Primary Examiner*—Roy Lake
*Assistant Examiner*—E. F. Desmond
*Attorney, Agent, or Firm*—R. S. Sciascia; Paul S. Collignon

[57] ABSTRACT

An electrical cable connector for use with a shielded conductor cable. A threaded coupling means is provided with a plurality of electrical contact elements and a threaded cylindrical extender has one end threaded thereto. A cylindrical adapter is connected with the braided shield of a cable and the conductors pass through a bore in the cylindrical adapter and are connected to the electrical contacts. The cylindrical adapter is threaded with the cylindrical extender. In case of repair, the cylindrical extender can be unthreaded from the coupling means and the cylindrical adapter to permit access to the solder joints between the electrical contacts and the conductors.

6 Claims, 5 Drawing Figures

REPAIRABLE SHIELDED CABLE CONNECTOR

BACKGROUND OF THE INVENTION

The present invention relates to a cable connector and more particularly to a connector for use with a shielded cable.

Cables having detachable connectors on each end are widely used, especially with ground support equipment for testing aircraft. These cables must be shielded, as stray radiation can result in an unsafe condition when armament circuits are being checked, and, in other situations, might result in erroneous readings. The use of shielded cables with connectors makes assembly more difficult and, in order to make an improved end product, connectors are frequently potted to the cable. This arrangement, however, makes field repair of the potted cable impossible, and the cable must be returned to a repair facility for rework.

Various arrangements have been devised in order to provide an electrical connector for use with a shielded cable so that inspection and repair can be made in the field. One such device is shown and described in U.S. Pat. No. 3,646,496, which issued Feb. 29, 1972, to Robert A. Williams. In this patented device, a connector is provided for securing a plurality of individual electrical conductors to receiving solder cups or connection pins, the connector having a housing consisting of a coupling means with multiple contact elements on a front portion thereof, a sizing shell that may be axially separated from the coupling means to expose the connection of the electrical conductors with the solder cups or pins, and a housing clamp axially releasable from the sizing shield to expose a separable ring surrounding the cable and being seated against a shoulder at the rear of the sizing shell. A ferrule is confined on the cable to urge a radially expanded portion of the shielding toward the split ring. A backup ring is urged by an insulating grommet sleeve against the ferrule, and a multifingered ring is jammed between the expanded portion of the shielding of the cable and the separable ring. As a consequence, the shielding is securely confined to the coupling means in a manner enabling interior inspection of the connector by removal of the housing clamp, division of the split ring, and subsequent axial removal of the sizing shell.

The main disadvantage of such repairable connectors and cables is that after one or more disassemblies, the braided shield around the cable becomes frayed and broken and subsequent assemblies become difficult, if not impossible, to make.

SUMMARY OF THE INVENTION

The present invention relates to a connector and cable assembly that is readily repairable and one that permits inspection and repair in the field. The braided shield of a cable is attached to a hollow cylindrical adapter with the conductors of the cable passing through a bore in the cylindrical adapter and being connected to the electrical contact elements of a threaded coupling. A threaded cylindrical extender is attached to the threaded coupling and the hollow cylindrical adapter, in turn, is connected to the cylindrical extender. The threaded cylindrical extender can be uncoupled from the coupling and adapter to permit access to the solder joints that connect the cable conductors with the electrical contacts of the connector.

It is therefore a general object of the present invention to provide a cable connector which can be readily attached and unattached to a braided shielded cable.

Other objects, advantages and novel features of the present invention will become apparent from the following detailed description of the invention when considered in conjunction with the accompanying drawings.

DECRIPTION OF THE PREFERRED EMBODIMENT

Figure 1:
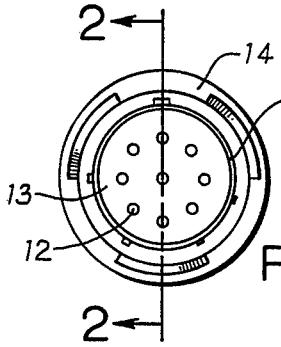
FIG. 1 is an end view of an electrical connector embodying the principles of the present invention.

Referring now to the drawing, there is shown a threaded coupling means 11 having a plurality of electrical contacts 12 that are spaced and positioned by an insulator 13. A rotatable locking ring 14 is provided so that the coupling means 11 can be attached with a mating connector. Electrical contacts 12 might be either male or female and preferably have a rearwardly extending cup portion 15 which is adaptable for receiving a wire which is preferably soldered thereto. The rearwardly extending portion of coupling means 11, which partially surrounds cup portions 15 is provided with external threads 16.

Figure 3:
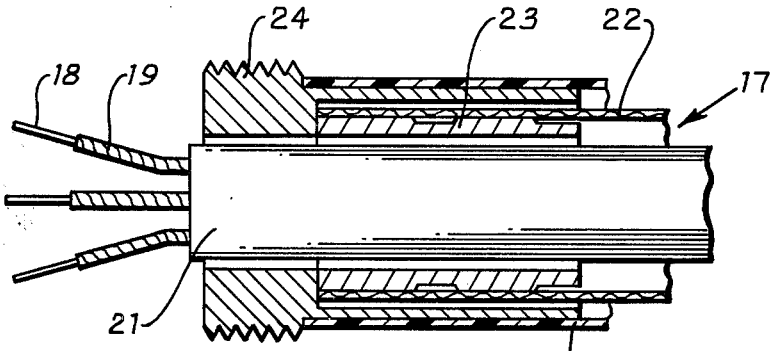
FIG. 3 is a partial sectional view showing an insert adapter prior to forming.
Figure 5:
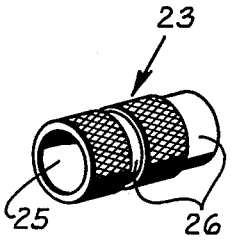
FIG. 5 is a perspective view of a shield terminator.
Figure 4:
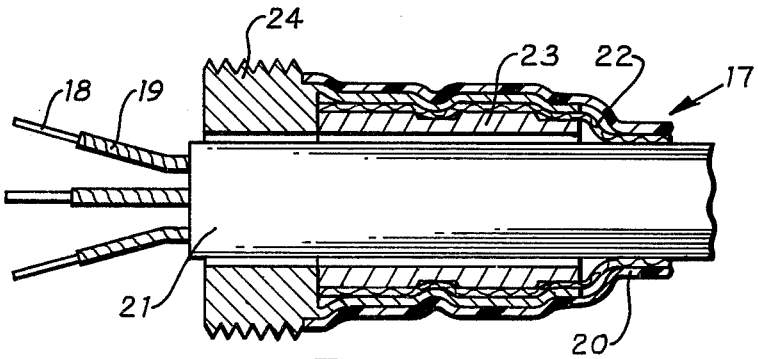
FIg. 4 is a partial sectional view showing an insert adapter after forming.

Referring now to FIGS. 3 and 4 of the drawing, a shielded cable 17 is shown having a plurality of conductors 18, each in insulation 19, an insulating sleeve 21, a braided metallic shield 22 and an outer cover 20. A terminator 23 is provided as a support element and has an outer diameter of a size that permits its fitting within the bore of a cylindrical insert adapter 24 with the braided shield being positioned between terminator 23 and adapter 24. By way of example, terminator 23 is positioned around cable 17 prior to the application of the braided shield 22 and shield 22 is braided directly onto terminator 23. As best shown in FIG. 5 of the drawing, terminator 23 is provided with a bore 25 sufficient in diameter to permit passage of cable 17 therethrough. Terminator 23 is provided with a pair of grooves 26 and the outer diameter of terminator 23 is knurled to facilitate holding of the braided shield 22. As best shown in FIG. 4 of the drawing, cylindrical insert adapter 24 is compressed or squeezed so that it becomes locked to terminator 23 with braided shield 22 being positioned therebetween. Grooves 26 facilitate the locking of these three parts. By way of example, adapter 24 is compressed onto terminator 23 by a magnetic pulse-forming method which is well-known in the art to form an outer part onto an inner part.

Figure 2:
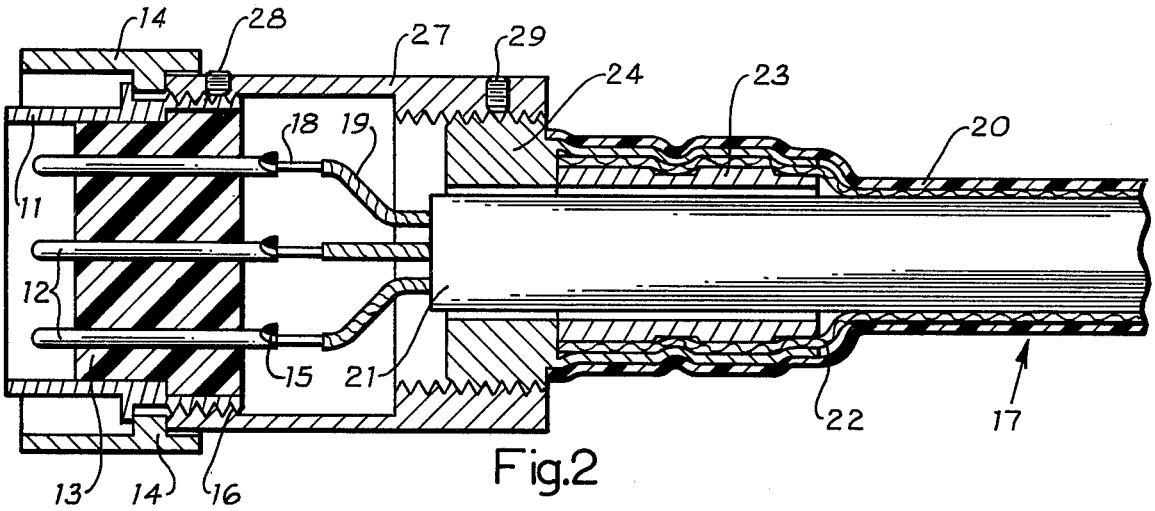
FIG. 2 is a sectional view taken on line 2—2 of FIG. 1.

Referring now to FIG. 2 of the drawing, conductors 18 are connected, as by soldering, to the cup portions 15 of contacts 12 and cylindrical extender 27 is threaded onto housing 11 and adapter 24 to secure cable 17 with the connector housing 11. At least one set screw 28 is provided in extender 27 to lock extender 27 with housing 11 and also at least one set screw 29 is provided in extender 27 to lock extender 27 with adapter 24.

It can readily be seen that, upon loosening of set screws 28 and 29, extender 27 can be unthreaded from coupling means 11 and adapter 24 and pushed back onto cable 17 to permit access to conductors.

Obviously many modifications and variations of the present invention are possible in the light of the above teachings. It is therefore to be understood that the invention may be practiced otherwise than as specifically described.

We claim:

1. An electrical connector for use with a multiconductor cable having a metallic shield thereon comprising, a threaded coupling means having a plurality of contact elements therein adapted to engage with mating contact elements of a mating coupling means, a cylindrical adapter having a bore therethrough and an outer enlarged threaded portion, a cylindrical terminator positioned within said bore of said cylindrical adapter and said metallic shield of said cable being positioned between the outer surface of said cylindrical terminator and the surface of the bore of said cylindrical adapter, and a cylindrical extender having first and second internal threaded sections, said first threaded section being engageable with said threaded coupling means and said second threaded section being engagable with said outer enlarged threaded portion of said cylindrical adapter.

2. An electrical connector for use with a multiconductor cable having a metallic shield thereon as set forth in claim 1 wherein said cylindrical terminator is provided with at least one groove around the periphery thereof and said cylindrical adapter is crimped to lock together said metallic shield, said cylindrical terminator and said cylindrical adapter.

3. An electrical connector for use with a multiconductor cable having a metallic shield thereon as set forth in claim 1 wherein said first internal threaded section of said cylindrical extender is larger in diameter than said second internal threaded section whereby said first internal threaded section can move over said outer enlarged threaded portion of said cylindrical adapter without having thread engagement.

4. A method for making an electrical connector and cable assembly comprising the steps of inserting a length of cable comprised of a plurality of conductors in an insulating sleeve through a bore of a cylindrical terminator of rigid material, then braiding a metallic shield around said cable and the outer surface of said cylindrical terminator of rigid material, then fastening said cylindrical terminator in the bore of a threaded cylindrical adapter and having the ends of said conductors extending beyond the end of said threaded cylindrical adapter, then attaching said conductors to the connector pins of an electrical connector having a rearwardly extending threaded portion, and then coupling said threaded cylindrical adapter to said rearwardly extending threaded portion of said electrical connector with a threaded cylindrical extender.

5. A method for making an electrical connector and cable assembly as set forth in claim 4 wherein said cylindrical adapter and said cylindrical terminator having a metallic shield braided thereon are crimped together by a compressive force.

6. A method for making an electrical connector and cable assembly as set forth in claim 5 wherein said compressive force is applied by magnetic pressure.

* * * * *